US010184739B2

(12) United States Patent
Gangl

(10) Patent No.: US 10,184,739 B2
(45) Date of Patent: Jan. 22, 2019

(54) FIREARM BOLT ASSEMBLY FOR A SELF-LOADING FIREARM

(71) Applicant: J & K IP Assets, LLC, Cheyenne, WY (US)

(72) Inventor: John Paul Gangl, White Bear Lake, MN (US)

(73) Assignee: J & K IP ASSETS, LLC, Cheyenne, WY (US)

( * ) Notice: Subject to any disclaimer, the term of this patent is extended or adjusted under 35 U.S.C. 154(b) by 0 days.

(21) Appl. No.: 14/958,840

(22) Filed: Dec. 3, 2015

(65) Prior Publication Data

US 2017/0160027 A1 Jun. 8, 2017

(51) Int. Cl.
*F41A 3/70* (2006.01)
*F41A 3/28* (2006.01)

(52) U.S. Cl.
CPC .. *F41A 3/70* (2013.01); *F41A 3/28* (2013.01)

(58) Field of Classification Search
CPC ..... F41A 3/70
See application file for complete search history.

(56) References Cited

U.S. PATENT DOCUMENTS 3,366,011 A * 1/1968 Sturtevant ..... F41A 3/70 89/198
4,150,819 A * 4/1979 Taylor ..... F41A 25/02 188/268
4,227,439 A * 10/1980 Gillum ..... F41A 3/40 89/180
4,279,091 A * 7/1981 Edwards ..... F41C 23/06 42/1.06
5,617,664 A * 4/1997 Troncoso ..... F41A 3/80 124/89
5,726,377 A * 3/1998 Harris ..... F41A 19/14 42/65
5,909,002 A * 6/1999 Atchisson ..... F41A 3/70 42/1.06
D449,668 S * 10/2001 Gangl, Jr. ..... D22/111
6,848,351 B1 * 2/2005 Davies ..... F41A 3/94 89/191.01
6,931,978 B1 * 8/2005 Dionne ..... F41A 3/12 42/69.02
7,421,937 B1 * 9/2008 Gangl ..... F41A 17/46 42/69.03

(Continued)

*Primary Examiner* — Troy Chambers
*Assistant Examiner* — Bridget A Cochran
(74) *Attorney, Agent, or Firm* — Bennet K. Langlotz; Langlotz Patent & Trademark Works, Inc.

(57) ABSTRACT

A firearm bolt assembly for a self-loading firearm has an elongated frame defining a frame axis, a bolt connected to a forward end of the frame, a plurality of separate weights connected to the frame, and the weights being movable at least slightly with respect to the frame and to each other for movement along the axis. There may be a resilient spacer element between adjacent weights. There may be a resilient spacer element between one of the weights and a portion of the frame. The spacer element may be an O-ring. The weights may be connected to a rear portion of the frame. The weights may be tubular bodies each defining a bore. A portion of the frame may be received within the bore. The frame may define a rear portion having a first diameter, and a flange forward of the rear portion having a larger second diameter.

14 Claims, 4 Drawing Sheets

(56) References Cited

U.S. PATENT DOCUMENTS

| | | | | |
|---|---|---|---|---|
| 8,800,424 | B2 | 8/2014 | Gangl et al. | |
| 8,839,545 | B1 * | 9/2014 | Gangl | F41A 11/00 42/75.03 |
| 9,217,614 | B2 * | 12/2015 | Pizano | F41A 3/26 |
| 2005/0260545 | A1 * | 11/2005 | Schavone | F41B 11/51 434/18 |
| 2005/0262752 | A1 * | 12/2005 | Robinson | F41A 3/26 42/71.01 |
| 2009/0151213 | A1 * | 6/2009 | Bell | F41A 19/15 42/69.03 |
| 2011/0185615 | A1 * | 8/2011 | Gangl | F41A 17/46 42/69.01 |
| 2012/0180648 | A1 * | 7/2012 | Sullivan | F16J 9/16 89/193 |
| 2013/0174457 | A1 * | 7/2013 | Gangl | F41A 3/18 42/16 |
| 2013/0319217 | A1 * | 12/2013 | Gangl | F41A 3/84 89/198 |
| 2014/0075798 | A1 * | 3/2014 | Kincel | F41A 3/84 42/1.06 |
| 2016/0047612 | A1 * | 2/2016 | Sullivan | F16J 9/16 89/191.01 |

* cited by examiner

FIREARM BOLT ASSEMBLY FOR A SELF-LOADING FIREARM

FIELD OF THE INVENTION

The present invention relates to firearms, and more particularly to firearm bolt assemblies for self-loading rifles.

BACKGROUND OF THE INVENTION

Many self-loading rifles with a rotating-lock bolt use direct gas impingement as their mechanism of operation. Gas is trapped from the barrel as the bullet moves past a gas port located above the rifle's front sight base. The gas rushes into the port and down a gas tube, located above the barrel, which runs from the front sight base into the rifle's upper receiver. Here, the gas tube protrudes into a "gas key" (bolt carrier key), which accepts the gas and funnels it into the bolt carrier.

The bolt and bolt carrier together effectively form a piston, which is caused to move as the cavity in the bolt carrier fills with high pressure gas. The bolt is locked into the barrel extension, so this expansion forces the bolt carrier backward a short distance in line with the stock of the rifle to first unlock the bolt. As the bolt carrier moves toward the butt of the gun, the bolt cam pin, riding in a slot on the bolt carrier, forces the bolt to turn and unlock from the barrel extension. Once the bolt is fully unlocked it begins its rearward movement along with the bolt carrier. The bolt's rearward motion extracts the empty cartridge case from the chamber, and as soon as the neck of the case clears the barrel extension, the bolt's spring-loaded ejector forces it out the ejection port in the side of the upper receiver. The bolt is much heavier than the projectile, and along with the recoil-spring pressure inside the stock buffer-tube performs the cartridge ejection function and chambers the following cartridge.

Behind the bolt carrier is a plastic or metal buffer which rests in line with a bolt return spring that pushes the bolt carrier back toward the chamber to return the bolt into battery. A groove machined into the upper receiver traps the cam pin and prevents it and the bolt from rotating into a closed position. The bolt's locking lugs then push a fresh round from the magazine which is guided by feed ramps into the chamber. As the bolt's locking lugs move past the barrel extension, the cam pin is allowed to twist into a pocket milled into the upper receiver. This twisting action follows the groove cut into the carrier and forces the bolt to twist and "lock" into the barrel's unique extension.

"Bolt bounce" is an undesirable phenomena associated with self-loading firearms, particularly fully automatic firearms. Specifically, when the bolt carrier comes forward and impacts the barrel extension, the potential exists for the bolt carrier to recoil slightly. This can have the undesirable effect of unlocking the bolt to a sufficient degree that the firearm is prevented from firing if the hammer falls again while the bolt is unlocked. Alternatively, if the bolt carrier is positioned excessively rearward when the hammer strikes the retracted firing pin during fully automatic fire, a misfire can occur because the bolt carrier absorbs energy from the hammer, thereby causing a too light strike by the hammer upon the firing pin.

Various solutions to the problem of bolt bounce exist, including the previously mentioned conventional buffered spring assemblies. Some of these have sliding weights inside the buffer portion, such as the buffer disclosed in U.S. Pat. No. 8,800,424, which is hereby incorporated by reference in its entirety. When the mass of the sliding weights is resonant with the rebound of the bolt carrier as it contacts the barrel extension, the forces will cancel each other, thereby keeping the bolt carrier against the barrel extension in the desired in battery position. However, some firearms cannot accommodate buffered spring assemblies in the stock, such as for pistol configurations. Furthermore, a conventional buffered spring assembly may be suitable for use with an unsuppressed fully automatic rifle using one kind of ammunition, but may have insufficient mass to adequately buffer the same rifle when a suppressor is used because of the greatly increased back pressure resulting from the suppressor, or when a different kind of ammunition is used. Overly energetic movement of the bolt carrier cannot only result in bolt bounce, but can also result in potentially excessive wear and tear on rifle components.

Therefore, a need exists for a new and improved firearm bolt assembly for a self-loading firearm that has a tunable bolt carrier mass that prevents bolt bounce. In this regard, the various embodiments of the present invention substantially fulfill at least some of these needs. In this respect, the firearm bolt assembly for a self-loading firearm according to the present invention substantially departs from the conventional concepts and designs of the prior art, and in doing so provides an apparatus primarily developed for the purpose of preventing bolt bounce.

SUMMARY OF THE INVENTION

The present invention provides an improved firearm bolt assembly for a self-loading firearm, and overcomes the above-mentioned disadvantages and drawbacks of the prior art. As such, the general purpose of the present invention, which will be described subsequently in greater detail, is to provide an improved firearm bolt assembly for a self-loading firearm that has all the advantages of the prior art mentioned above.

To attain this, the preferred embodiment of the present invention essentially comprises an elongated frame defining a frame axis, a bolt connected to a forward end of the frame, a plurality of separate weights connected to the frame, and the weights being movable at least slightly with respect to the frame and to each other for movement along the axis. There may be a resilient spacer element between adjacent weights. There may be a resilient spacer element between one of the weights and a portion of the frame. The spacer element may be an O-ring. The weights may be connected to a rear portion of the frame. The weights may be tubular bodies each defining a bore. A portion of the frame may be received within the bore. The frame may define a rear portion having a first diameter, and a flange forward of the rear portion having a second diameter larger than the first diameter. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
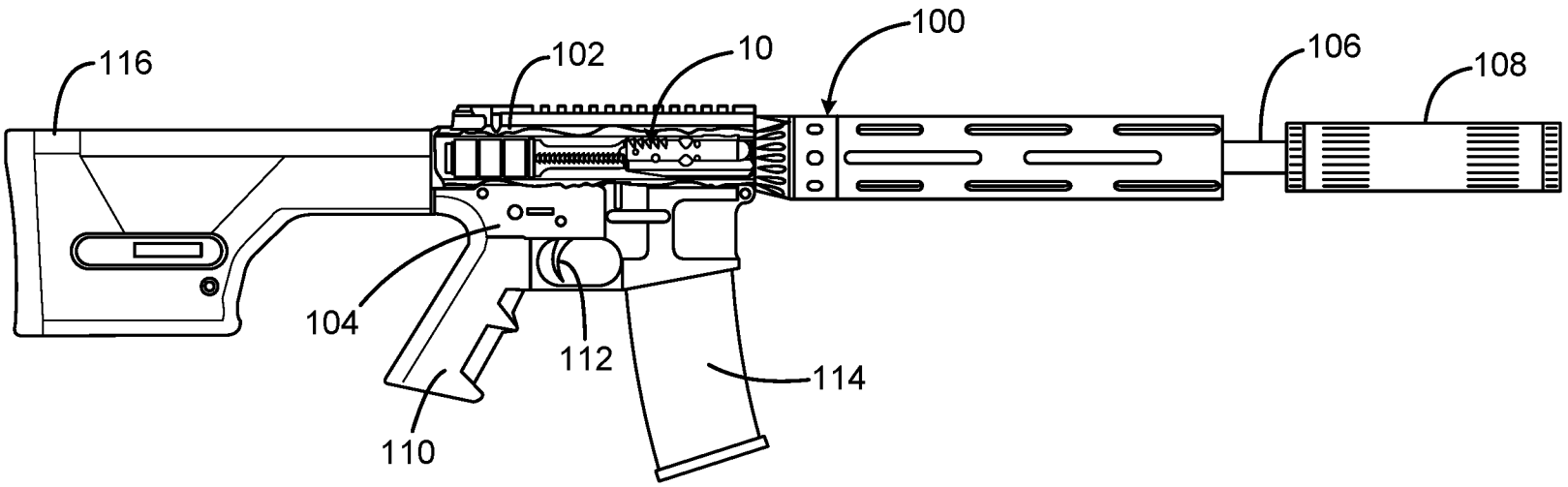
FIG. 1 is a right side view of the current embodiment of the firearm bolt assembly for a self-loading firearm installed in a firearm.
Figure 2:
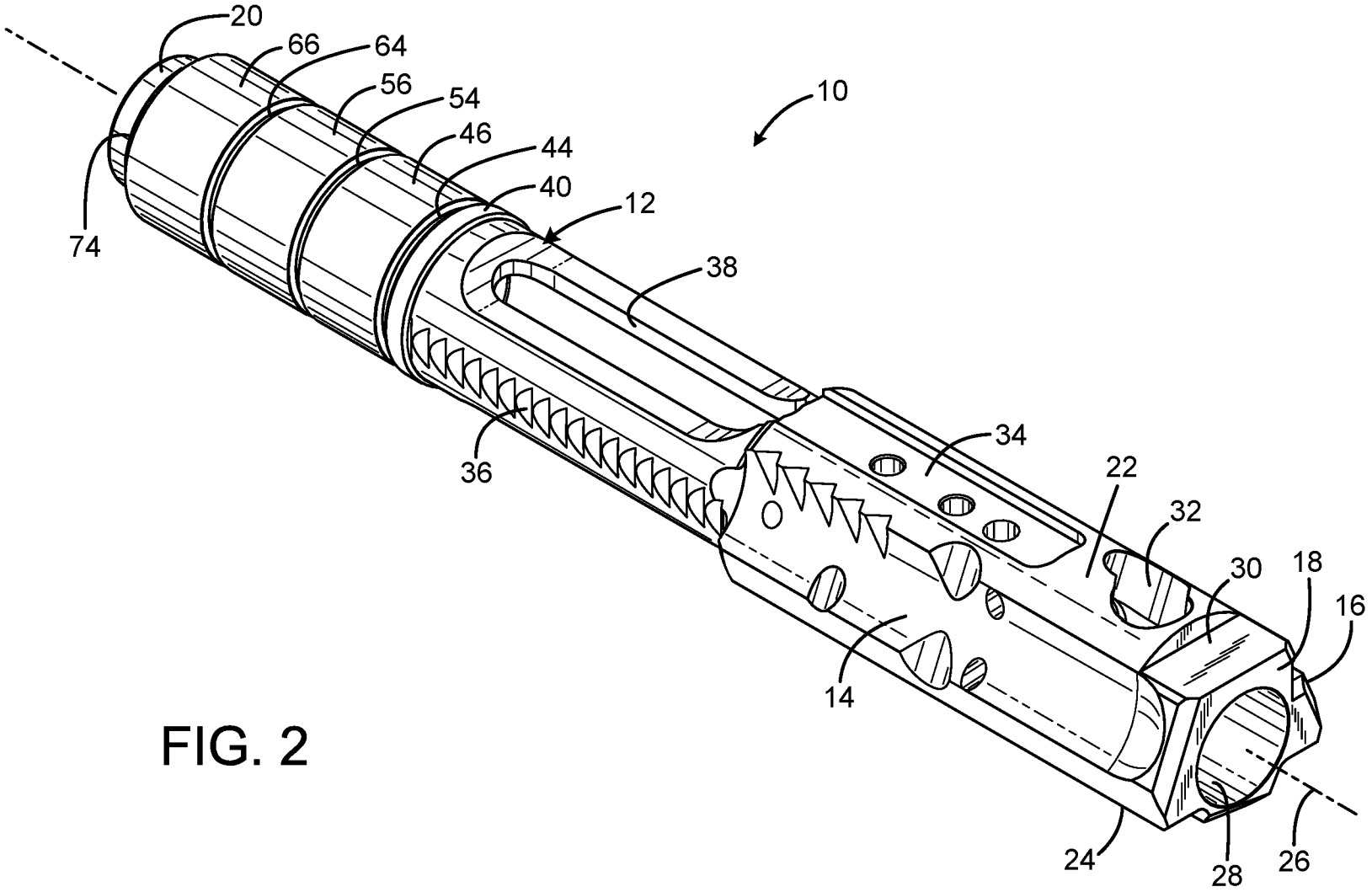
FIG. 2 is a front isometric view of the current embodiment of the firearm bolt assembly for a self-loading firearm constructed in accordance with the principles of the present invention.
Figure 3:
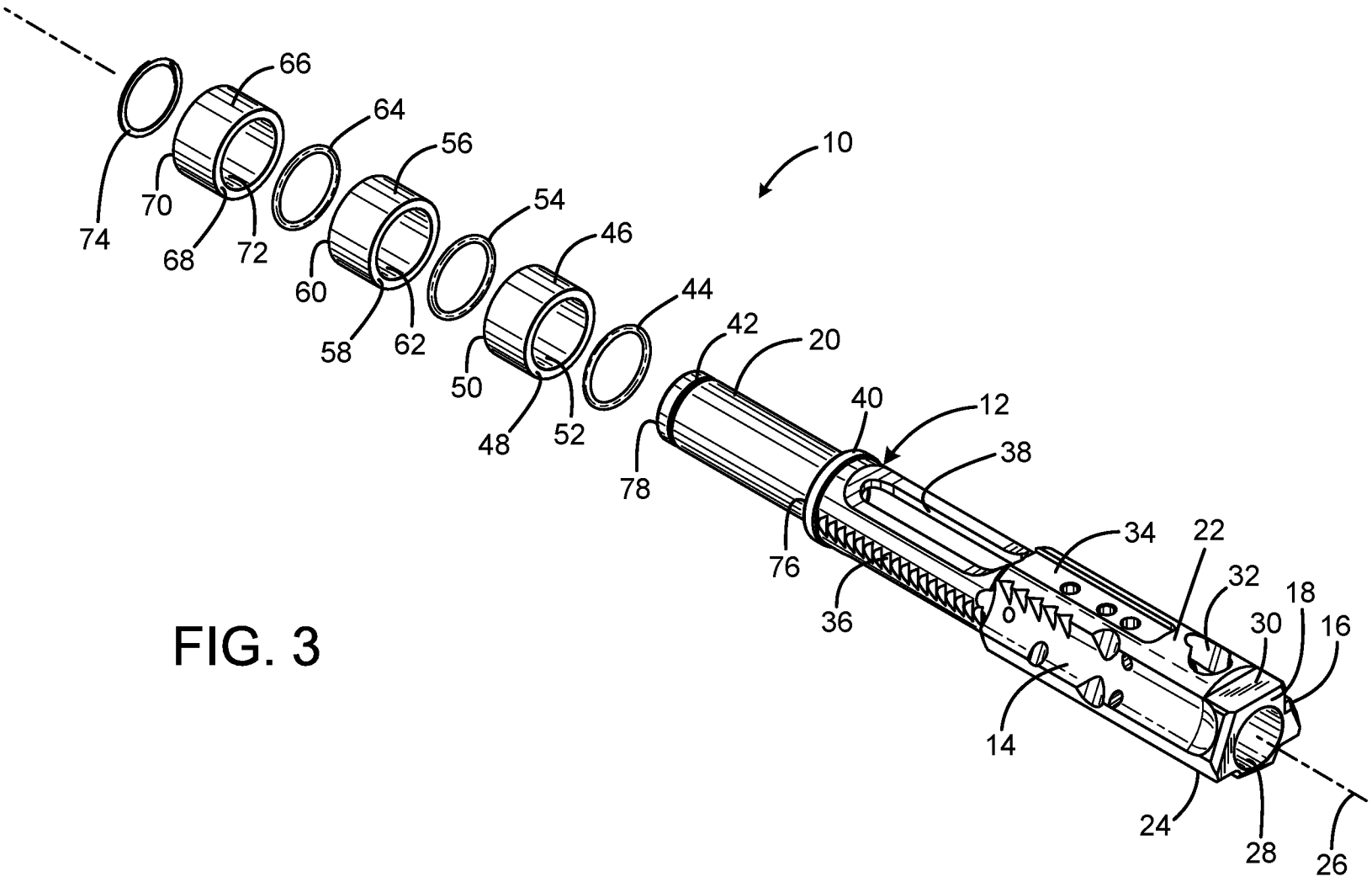
FIG. 3 is an exploded view of the firearm bolt assembly for a self-loading firearm of FIG. 2.
Figure 4:
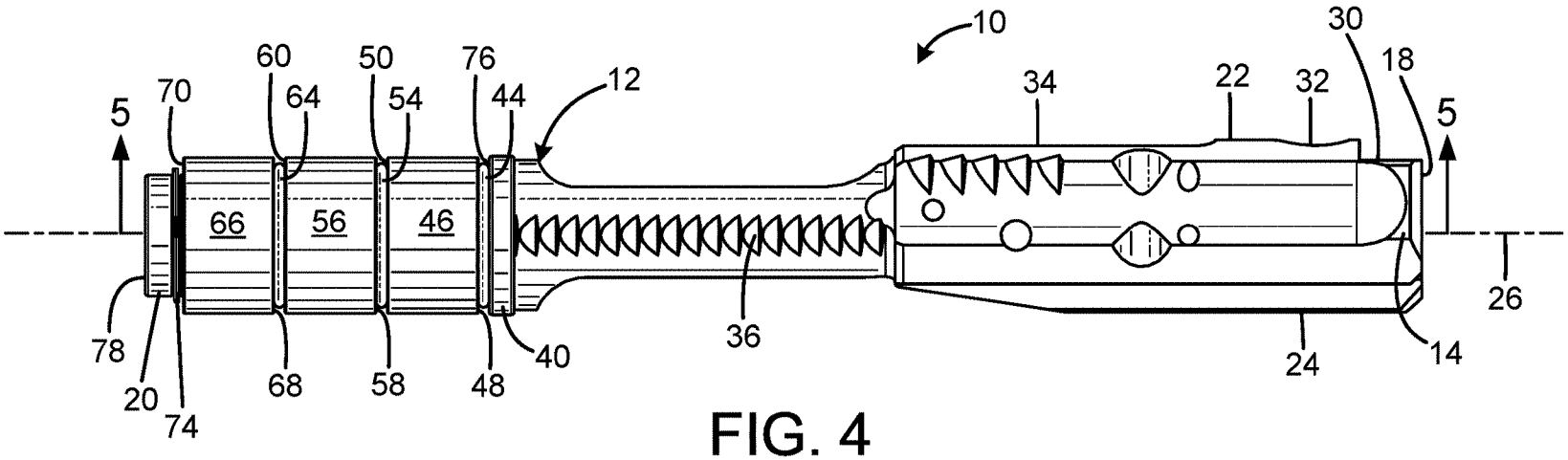
FIG. 4 is a right side view of the firearm bolt assembly for a self-loading firearm of FIG. 2.
Figure 5:
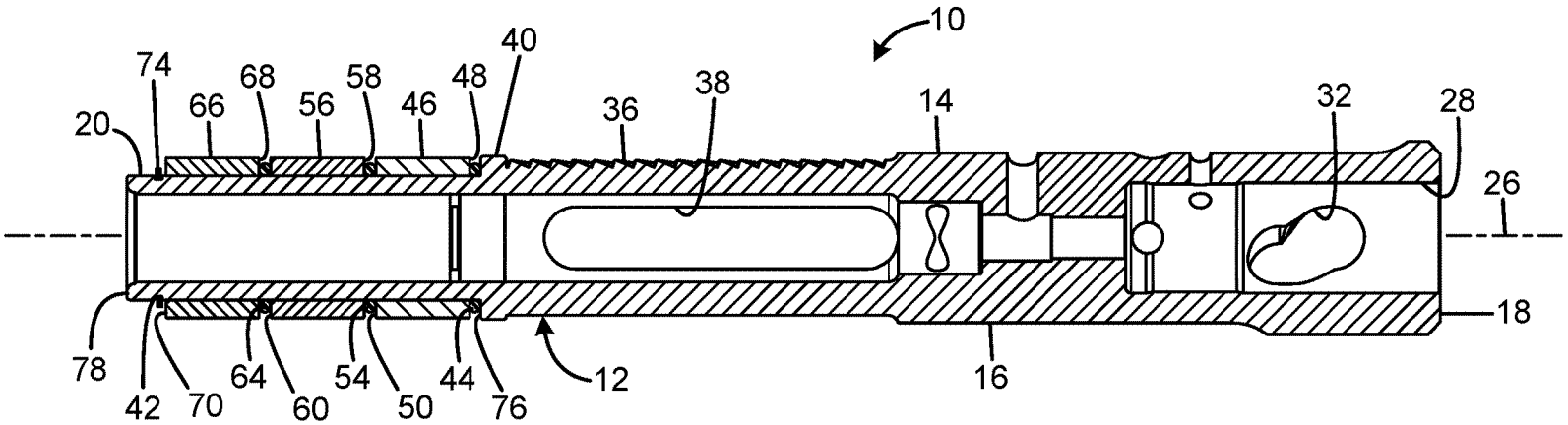
FIG. 5 is a bottom sectional view of the firearm bolt assembly for a self-loading firearm of FIG. 2.

An embodiment of the firearm bolt assembly for a self-loading firearm of the present invention is shown and generally designated by the reference numeral 10.

FIG. 1 illustrates the improved firearm bolt assembly for a self-loading firearm 10 of the present invention. More particularly, the firearm bolt assembly is shown installed in a firearm 100. The firearm has an upper receiver 102, lower receiver 104, barrel 106, suppressor 108, pistol grip 110, trigger 112, magazine 114, and buttstock 116. In the current embodiment, the firearm is an auto-loading rifle.

FIGS. 2-5 illustrate the improved firearm bolt assembly for a self-loading firearm 10 of the present invention. More particularly, the firearm bolt assembly has a bolt carrier frame 12 having a right side 14, left side 16, front face 18, rear portion 20, top 22, and bottom 24. The frame defines a longitudinal frame axis 26, and the front face defines a central bore 28. The top front of the frame defines a charging handle engagement shelf 30. A cam slot 32 is defined by the top of the frame immediately behind the charging handle engagement shelf. A carrier key attachment area 34 is machined in the top of the frame directly behind the cam slot. A plurality of forward assist notches 36 are machined in the right side of the frame immediately behind the carrier key attachment area. A hammer clearance slot 38, which communicates with the central bore 28 is machined in the top of the frame immediately behind the carrier key attachment area. A flange 40 integral to the frame having a rear face 76 is located immediately behind the hammer clearance slot and forward assist notches. A rear portion 20 extends rearwardly from the rear face of the flange to the rear 78 of the frame. A small turned groove 42 is present adjacent to the rear of the frame.

A stack of cylindrical, tubular weights 46, 56, 66 separated by resilient spacer elements in the form of elastomeric O-rings 44, 54, 64 is received on the rear portion 20. The front weight 46 has a front 48, rear 50, and central bore 52. The intermediate weight 56 has a front 58, rear 60, and central bore 62. The rear weight 66 has a front 68, rear 70, and central bore 72. The central bores of the weights are sufficiently larger than the outer diameter of the rear portion 20 of the frame 12 to enable the weights to be slidably received on the rear portion. O-ring 44 separates the front of the front weight from the rear face 76 of the flange 40 of the frame. O-ring 54 separates the rear of the front weight from the front of the intermediate weight. O-ring 64 separates the rear of the intermediate weight from the front of the rear weight. A retention fastener 74, which is a spiral ring made of spring steel in the current embodiment, is snapped into the groove 42 to hold the stack of cylindrical weights and O-rings on the rear portion of the frame. The weights are stacked tightly, but the compressibility of the O-rings means the weights are free to slightly reciprocate along the rear portion of the frame. This movement of the weights provide some damping, like a dead-blow hammer, and helps to absorb some energy in the manner of a buffer.

The weights 46, 56, 66 may be made of different materials having different densities, so that the user or assembler may choose from a range of selected bolt carrier masses determined by the particular weights attached to the bolt carrier frame 12. These metals may include stainless steel and tungsten, as well as other materials including lighter materials such as aluminum or non-metal materials. The bolt carrier frame and weights may be supplied as a kit, with potentially more weights in the kit than can be installed, such as three each of stainless steel and tungsten, with the user or assembler selecting what combination of different metals to use.

In the preferred embodiment, the mass of a stainless steel weight is 0.58 oz., and the mass of a tungsten weight is 1.36 oz. Therefore, the total mass of the bolt carrier may be varied in steps equal to the difference "D" between the stainless steel and tungsten weights, with the total range of selectable weights being equal to 3×D. The factor of 3 may of course vary based on the number of weights for which length on the rear portion 20 of the frame is provided. The weights may each have the same length, even when being made of different materials.

The need to change the bolt carrier frame mass (or to provide a custom selected mass) may be based on many factors, including the type of ammunition used, whether or not a suppressor is used, whether firing is fully automatic or semi-automatic, and the type of shooting to be performed. The buffering effect of the rubber O-rings and the ability to tune the mass of the bolt carrier frame so the bolt fully cycles but does not move overly energetically is believed to reduce "bolt bounce," especially from fully automatic, suppressed firearm operation, that can cause firearm malfunctions, as well as potentially excessive wear and tear on rifle components.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a firearm bolt assembly for a self-loading firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a gas impingement mechanism of operation has been disclosed, piston or blowback-operated mechanisms of operation could also be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm bolt assembly for a self-loading firearm comprising:

a bolt carrier frame defining a frame axis and having a forward end portion, an opposed rear end, and an intermediate portion of the rear end portion between the forward end portion and the rear end;

wherein the bolt carrier frame is an elongated unitary body;

the forward end defining a bolt receptacle adapted to receive a bolt;

a plurality of separate weights connected to the frame at a position forward of the rear end;

wherein the weights are tubular bodies each defining a bore, and wherein a portion of the frame is received within the bores;

the intermediate portion being encompassed by the weights such that no portion of the intermediate portion is outside the weights; and the weights being movable at least slightly with respect to the frame and to each other for movement along the axis.

2. The firearm bolt assembly of claim 1 further comprising a resilient spacer element between adjacent weights.

3. The firearm bolt assembly of claim 2 wherein the spacer element is an O-ring.

4. The firearm bolt assembly of claim 1 further comprising a resilient spacer element between one of the weights and a portion of the frame.

5. The firearm bolt assembly of claim 4 wherein the spacer element is an O-ring.

6. The firearm bolt assembly of claim 1 wherein the weights are connected to a rear portion of the frame.

7. The firearm bolt assembly of claim 1 wherein the frame defines a rear portion having a first diameter, and a flange forward of the rear portion having a second diameter larger than the first diameter, and wherein the weights each define a bore having an internal diameter intermediate the first diameter and the second diameter.

8. The firearm bolt assembly of claim 7 including a resilient element adjacent to the flange and a weight adjacent to the resilient element.

9. The firearm bolt assembly of claim 1 wherein the weights are selected from a set of weights including a plurality of different weight materials.

10. The firearm bolt assembly of claim 1 wherein the weights are selected from a set of weights including a plurality of different weight material densities.

11. The firearm bolt assembly of claim 1 wherein the weights are selected from a set of weights including a plurality of different weight masses each having the same length.

12. The firearm bolt assembly of claim 1 wherein the weights are selected from a set of weights each have the same length.

13. The firearm bolt assembly of claim 1 wherein the weights are arranged in a stack alternating with intervening resilient elements.

14. The firearm bolt assembly of claim 1 further comprising a fastener on the frame to the rear of the weights to prevent the extraction of the weights from the frame.

* * * * *